US010670207B2

(12) United States Patent
Hierzer

(10) Patent No.: US 10,670,207 B2
(45) Date of Patent: Jun. 2, 2020

(54) LAMP

(71) Applicant: H4X e.U., Graz (AT)

(72) Inventor: Andreas Hierzer, Graz (AT)

(73) Assignee: H4X e.U., Graz (AT)

( * ) Notice: Subject to any disclaimer, the term of this patent is extended or adjusted under 35 U.S.C. 154(b) by 0 days.

(21) Appl. No.: 15/895,287

(22) Filed: Feb. 13, 2018

(65) Prior Publication Data

US 2018/0231200 A1 Aug. 16, 2018

(30) Foreign Application Priority Data

Feb. 15, 2017 (DE) ..... 10 2017 202 400

(51) Int. Cl.
*F21S 4/00* (2016.01)
*F21V 21/00* (2006.01)
(Continued)

(52) U.S. Cl.
CPC ..... *F21S 8/046* (2013.01); *F21S 8/043* (2013.01); *F21V 7/005* (2013.01); *F21V 7/0008* (2013.01);
(Continued)

(58) Field of Classification Search
CPC ..... F21S 8/00; F21S 8/04; F21S 8/043; F21S 8/046; F21V 7/00; F21V 7/0008; F21V 7/0025; F21V 7/0033; F21V 7/005; F21V 7/04; F21V 7/046; F21V 7/048; F21V 7/06; F21V 7/07; F21V 7/08; F21V 7/09; F21V 21/30; F21V 29/50; F21V 29/70; F21V 29/83; F21Y 2103/10; F21Y 2115/10
(Continued)

(56) References Cited

U.S. PATENT DOCUMENTS 6,450,668 B1 * 9/2002 Kotloff ..... F21S 8/06 362/221
7,578,600 B2 8/2009 Czajkowski
(Continued)

FOREIGN PATENT DOCUMENTS

DE 20 2014 103 431 U1 12/2015
EP 1671063 B1 3/2013
WO 05036054 A1 4/2005

OTHER PUBLICATIONS

European Search Report dated Feb. 1, 2018 issued in corresponding EP 17209240.5 application (7 pages).
German Office Action dated Oct. 5, 2017 issued in corresponding DE 10 2017 202 400.3 application (4 pages).
(Continued)

*Primary Examiner* — Jason M Han
(74) *Attorney, Agent, or Firm* — Millen, White, Zelano & Branigan, P.C.; William Nixon

(57) ABSTRACT

A lamp has a carrier device and at least one lighting device mounted on the carrier device. The at least one lighting device has a carrier part, a plurality of lighting units which are arranged on a lateral wall of the carrier part, and a reflector device fastened to the carrier part. The reflector device has at least two reflector portions at a distance from one another in a longitudinal direction, which are each formed by reflector surfaces which are concavely curved in at least two curvature directions, wherein the at least two reflector portions are oriented facing the lateral wall of the carrier part, and wherein in each case one lighting unit is assigned in each case to one of the at least two reflector portions.

19 Claims, 5 Drawing Sheets

(51) Int. Cl.

| | |
|---|---|
| ***F21S 8/04*** | (2006.01) |
| ***F21V 7/00*** | (2006.01) |
| ***F21V 7/04*** | (2006.01) |
| ***F21V 29/83*** | (2015.01) |
| ***F21V 21/30*** | (2006.01) |
| *F21Y 103/10* | (2016.01) |
| *F21Y 115/10* | (2016.01) |

(52) U.S. Cl.
CPC ..... *F21V 7/0025* (2013.01); *F21V 7/046* (2013.01); *F21V 21/30* (2013.01); *F21V 29/83* (2015.01); *F21Y 2103/10* (2016.08); *F21Y 2115/10* (2016.08)

(58) Field of Classification Search
USPC ..... 362/217–225, 249.02, 311.02, 800
See application file for complete search history.

(56) References Cited

U.S. PATENT DOCUMENTS

| | | | | |
|---|---|---|---|---|
| 8,038,314 | B2 * | 10/2011 | Ladewig | F21V 7/0008 362/217.12 |
| 8,206,005 | B2 | 6/2012 | Czajkowski | |
| 2005/0094393 | A1 | 5/2005 | Czajkowski | |
| 2005/0094401 | A1 | 5/2005 | Magarill | |
| 2009/0303716 | A1 | 12/2009 | Czajkowski | |
| 2011/0069484 | A1 | 3/2011 | Wu et al. | |
| 2011/0164417 | A1 | 7/2011 | Huang | |
| 2013/0201715 | A1 | 8/2013 | Dau et al. | |
| 2017/0023229 | A1 | 1/2017 | Klase et al. | |

OTHER PUBLICATIONS

English Abstract of DE 20 2014 103 431 published Dec. 3, 2015.
Search Report in corresponding DE 102017202400.3 dated Sep. 17, 2019 (pp. 1-7).

* cited by examiner

LAMP

FIELD OF THE INVENTION

The present invention relates to a lamp, in particular to a lamp for illuminating aisles, such as aisles in which articles for sale are stored, for example on shelves.

BACKGROUND

In shops, for example in supermarkets, clothing shops, DIY shops, or in warehouses, articles are conventionally stored and presented on shelves or similar storage means. The storage means are usually arranged in aisles so that customers can look at the articles from the aisles and take said articles out of the storage means. In order to illuminate the aisle itself and the articles, lamps are generally arranged above the aisles. Since both the arrangement of the articles in the storage means and the arrangement of the storage means themselves change frequently, the illumination must be adapted accordingly.

For adaptation to the local circumstances, DE 20 2014 103 431 U1 describes for example a lamp comprising an elongate housing and two lighting units which are rotatably mounted thereon. As a result, an adaptation of an angle at which light is emitted by the lamp can be set and adapted to the local circumstances. The lighting units each comprise LEDs and a reflector in the form of a curved plate extending over the entire length of the lighting unit. At either end of said plate, planar plates tilted obliquely outwards and downwards are provided. In this way, it is ensured that the intensity of the emitted light decreases continuously in the direction of the longitudinal extension of the lamp, by means of which stark changes in the lighting are avoided.

In order to present articles in an attractive manner, importance is mostly placed on achieving the most uniform possible lighting of the articles along the aisles. Furthermore, the aisles should be lit with a brightness which is pleasant for the customers. In order to uniformly illuminate longer aisles, a plurality of lamps or larger lamps of the above-described type are therefore usually required.

SUMMARY OF THE INVENTION

An idea of the present invention is therefore that of providing a lamp which has a compact construction and improved lighting properties, in particular with respect to the size of the surface to be lit and/or with respect to the uniform illumination of a predetermined surface to be lit and/or with respect to dazzle properties.

According to the invention, a lamp comprising a carrier device and at least one lighting device extending in a longitudinal direction and mounted on the carrier device is provided. The lighting device comprises a carrier part extending in the longitudinal direction, a plurality of lighting units which are arranged on a lateral wall of the carrier part, and a reflector device which is fastened to the carrier part. The reflector device has at least two reflector portions at a distance from one another in the longitudinal direction, which portions are each formed by reflector surfaces which are concavely curved in at least two curvature directions. The at least two reflector portions are oriented facing the lateral wall of the carrier part. Furthermore, a lighting unit is assigned in each case to one of the at least two reflector portions.

According to the invention, a lamp comprising a carrier device, which is provided for fastening to a ceiling of a room of a building, and at least one lighting device are thus provided. The at least one lighting device is mounted or arranged on the carrier device and is thus mechanically coupled to the at least one lighting device. The at least one lighting device comprises a carrier part or a carrier structure which extends in a longitudinal direction. The at least one lighting device is used to emit light and accordingly comprises a plurality of lighting units which are arranged on the carrier part, in particular on a lateral wall of the carrier part extending in the longitudinal direction. In the simplest case, the carrier part can thus for example be in the form of an elongate plate. The at least one lighting device further comprises a reflector device for reflecting the light which can be emitted by the lighting units. The reflector device has at least two reflector portions or reflector regions at a distance from one another in the longitudinal direction, which portions are each formed by reflector surfaces which are concavely curved in at least two curvature directions. The individual reflector portions thus each form open cavities which are separated from one another with respect to the longitudinal direction and which are defined or delimited by reflector surfaces provided to reflect light. The at least two reflector portions are oriented facing the lateral wall of the carrier part, that is to say that the respective reflector surfaces are oriented facing the lateral wall on which the lighting units are arranged. In this case, at least one lighting unit is assigned to each reflector portion and is arranged on the lateral wall opposite said portion so that light can be emitted onto the surface forming the relevant reflector portion and can be reflected thereby to illuminate a lighting region. The curvature of the reflector surfaces is designed in such a way that the light which can be emitted by means of the lighting units is reflected in a direction which is transverse to the longitudinal direction.

By means of this design of the lighting device, according to which a plurality of discrete reflector portions are provided in the form of surface regions which are curved concavely in at least two curvature directions, the reflector surface is enlarged in the longitudinal direction with respect to the length of the lighting device. For a pre-set size of the reflector surface overall, the length of the lighting device and thus of the lamp is thus advantageously reduced. Since, furthermore, in each case one reflector portion is irradiated by one or more individual illuminant devices, a very high light output is achieved per reflector portion. The light output is thus increased with respect to the length of the lamp. Furthermore, by means of the concave, multi-axis curvature, a particularly uniform distribution of light, in particular with respect to the longitudinal direction, is achieved. In this case, the special curvature of the reflector portions means that, by means of two or more reflector portions, a larger surface can be illuminated than by conventional lamps of the same size. Furthermore, by means of the curvature of the reflector portions and the separate arrangement thereof, dazzle with respect to a viewing direction in the longitudinal direction is prevented in an improved manner.

According to one embodiment of the lamp, the number of lighting units can correspond to the number of reflector portions, and in each case one lighting unit can be arranged opposite a relevant reflector portion and assigned thereto. In this case, precisely one lighting unit is thus provided per reflector portion in each case. This offers the advantage that a large lighting region can be illuminated by a minimal number of lighting means. The space required for the lighting units is thus reduced, which facilitates a compact construction of the lamp.

According to another embodiment, it can be provided that a plurality of cooling stacks placed one behind the other with respect to the longitudinal direction are formed on the lateral wall of the carrier part, which stacks extend in a lighting-device vertical direction extending transversely to the longitudinal direction. When the lamp is mounted on a ceiling, the lighting-device vertical direction extends at an angle of less than 90 degrees to the direction of gravity. According to this embodiment, cooling stacks, e.g. in the form of channels, are thus provided, which each have two openings opposite one another in the lighting-device vertical direction, which are connected by peripheral walls of the respective cooling stacks. The peripheral walls thus define the cross-sectional shape of the respective cooling stacks and extend between the opposing openings. Since the cooling stacks are formed on the lateral wall of the carrier part, on which the lighting units are also arranged, one of the peripheral walls is formed by the lateral wall of the carrier part. Consequently, the heat dissipation from the lighting unit is improved by cooling stacks since, by means of the extension of the cooling stacks in the lighting-device vertical direction, the stack effect achieved as a result of the heating of the lateral wall ensures improved convection. By means of the improved cooling, the capacity of the lighting units can be further increased, and thus the number of lighting units which are required to achieve a desired lighting output can be reduced. Consequently, the lamp can have a smaller and more compact construction.

Optionally, the cooling stacks can be formed integrally with the lateral wall, for example by a casting process.

Generally, the carrier part can be produced from a metal material, for example an aluminium alloy or aluminium. Due to the high thermal conductivity of metal materials, in particular of aluminium alloys or aluminium, the heat dissipation of the lamp is improved so that the output of the illuminant devices can be further increased.

According to another embodiment, it can be provided that the carrier part of the lighting device comprises a plurality of ribs which extend from the lateral wall of the carrier part at least in portions in a lighting-device vertical direction extending transversely to the longitudinal direction. Accordingly, the carrier part comprises a plurality of ribs arranged on the lateral wall, which ribs are arranged at a distance from one another with respect to the longitudinal direction. It can be provided that the ribs are formed integrally with the lateral wall of the carrier part or are fastened thereto, for example in an integrally bonded, interlocking or force-locked manner. An extension at least in portions in the lighting-device vertical direction can be produced for example by L-shaped or arcuate ribs. By means of the direct contact of the ribs with the lateral wall of the carrier part, the ribs are thermally coupled to the lateral wall. As a result, the surface area of the carrier part is enlarged, and the heat dissipation and cooling of the lighting units are thus further improved. In addition, the ribs advantageously provide a mounting surface, e.g. for fastening the reflector device.

According to another embodiment of the lamp, it can be provided that the reflector surfaces forming the at least two reflector portions and a first surface of the lateral wall of the carrier part, on which the lighting units are arranged, together define in each case one light outlet opening of the lamp. In this case, each reflector surface thus reaches as far as the inner face of the lateral wall of the carrier part, which face is oriented facing the reflector device, or ends at said inner face. An intermediate reflector segment, which extends between two successive reflector portions with respect to the longitudinal direction, is thus in contact with the inner face or the first surface of the lateral wall of the carrier part. Particularly good dazzle suppression is thus achieved in a viewing direction oblique to or in the longitudinal direction, since the view of the illuminant devices is obstructed.

Alternatively, it can be provided that the at least one lighting device further comprises a cover strip, wherein the cover strip is arranged on a first surface of the lateral wall of the carrier part, on which the lighting units are arranged. In this case, an elongate strip, that is to say a strip extending in the longitudinal direction, is arranged on the inner face of the lateral wall oriented facing the reflector device and thus protrudes from the inner face. In particular, with respect to a lighting-device width direction extending transversely to the lighting-device vertical direction, the cover strip is arranged between a lower end portion and the relevant lighting unit. The lighting units are thus shaded by the strip with respect to a viewing direction in the lighting-device vertical direction so that dazzle from the lighting units is prevented in an improved manner.

According to one development, it can additionally be provided that the reflector surfaces forming the at least two reflector portions and the cover strip together define one light outlet opening of the lamp in each case. In this case, the relevant reflector surface reaches as far as the cover strip or ends at said strip. An intermediate reflector segment, which extends between two successive reflector portions with respect to the longitudinal direction, is thus in contact with the cover strip. Particularly good dazzle suppression is thus achieved in a viewing direction oblique to or in the longitudinal direction.

According to another embodiment of the lamp, the lighting units can each be in particular in the form of LED lighting units. Accordingly, a lighting unit comprises one or more light-emitting diodes, or LEDs for short. LEDs offer the advantage that high light intensities can be achieved with a relatively low heat output.

Optionally, the lighting units can be in the form of chip-on-board LED units or in the form of chip-scale-packaging LED units. In this case, "COB" is an abbreviation for the expression chip-on-board. COB LED units comprise a plurality of LED elements or LED chips, which are arranged on a carrier substrate and are electrically connected in parallel or in series thereon and covered with a covering layer, e.g. a phosphor layer. COB LED units have a high power density with respect to the space requirements thereof, and this facilitates a compact construction of the lamp. Furthermore, COB LED units offer the advantage that they have a uniform beam quality and a high colour-rendering index. Chip-scale-packaging LED units, known as CSP LED units for short, likewise have a high power density with respect to the space requirements thereof.

According to another embodiment of the lamp, it can be provided that the lighting units are each configured for an electric power supply with an operating current of between 300 milliamperes (mA) and 1050 mA. In this range, particularly high light outputs of the lighting units are achieved. In particular for COB LED units, in this range, light outputs in the range of approximately 1850 lumen per LED unit can be achieved. As a result, a desired brightness can be achieved with few LED units, and this further facilitates a compact design of the lamp.

According to one embodiment, the at least one lighting device can be mounted on the carrier device so as to be able to rotate about a pivot axis extending in the longitudinal direction. The lighting device is accordingly pivotable with respect to a pivot axis extending in the longitudinal direction. Consequently, the orientation of the lighting device, and thus the radiation direction of the light which can be emitted by means of the lighting units via the reflector portions, can be adjusted. This advantageously increases the flexibility when attaching the lamp relative to a region to be lit.

According to another embodiment, it can be provided that the carrier device comprises a longitudinal carrier extending in the longitudinal direction, a first transverse carrier arranged on a first end portion of the longitudinal carrier and extending transversely thereto, and a second transverse carrier which is arranged on a second end portion of the longitudinal carrier and extends transversely to the longitudinal carrier. In this case, the at least one lighting device can be mounted for example on the transverse carriers.

As an alternative to this design of the carrier device, the carrier device can also be in the form of a peripheral, rectangular frame. In this case, the carrier device thus comprises two longitudinal struts extending in the longitudinal direction and two transverse struts extending transversely to and interconnecting said longitudinal struts. Optionally, a peripheral strip protruding outwards from the struts can further be provided on the carrier device. The peripheral frame can advantageously be inserted into a mounting recess, which is provided for example in a ceiling of a room of a building. In this case, the optional strip is used for attachment to the ceiling. Furthermore, a fastening device can be provided on the carrier device to fasten the frame to a ceiling. In particular, the fastening device can be in the form of a bracket which is rotatably mounted on the carrier device and is biased by means of a spring. The bracket is provided in particular to engage behind a region of a ceiling of a room of a building.

According to another embodiment, the lamp can comprise a fixing device for fixing the at least one lighting device in a pivot position. The fixing device can be formed for example by a latching mechanism, which latches, and thereby fixes, the at least one lighting device to the carrier device in specific pivot positions.

According to one embodiment, it can be provided that the lamp comprises a first lighting device and a second lighting device.

In particular, it can be provided that the at least two reflector portions of the first lighting device and the at least two reflector portions of the second lighting device are oriented in opposite directions. Accordingly, with respect to a centre plane extending in the longitudinal direction and in the vertical direction, the first and the second lighting devices are arranged on different sides of the centre plane, and the reflector surfaces are oriented facing away from the centre plane.

Alternatively, it can also be provided that the at least two reflector portions of the first lighting device and the at least two reflector portions of the second lighting device are oriented so as to be mutually facing. According to this optional configuration, with respect to the centre plane, the first and the second lighting devices are arranged on different sides of the centre plane, and the reflector surfaces are oriented facing the centre plane.

These optional configurations of the lamp are advantageous in particular for use in aisles extending between opposing regions to be lit. By means of the above-described construction comprising a first and a second lighting device, which devices emit light towards opposite sides, the regions to be lit, which are arranged on either side of the aisle, can be lit by a lamp.

In this case, components which are formed "integrally" or "in one piece" are generally understood to mean that said components are in the form of a single part forming a material unit, and in particular are produced as such, with one of the components not being able to be detached from the other components without breaking up the material cohesion.

With respect to directional information and axes, in particular directional information and axes which relate to the course of physical structures, a course of an axis, a direction or a structure "along" another axis, direction or structure is understood to mean that these, in particular the tangents which are produced at a relevant point on the structures, each extend at an angle of less than or equal to 45 degrees, for example of less than 30 degrees, and for example extend in parallel with one another.

With respect to directional information and axes, in particular directional information and axes which relate to the course of physical structures, a course of an axis, a direction or a structure "transversely to" another axis, direction or structure is understood to mean that these, in particular the tangents which are produced at a relevant point on the structures, each extend at an angle of greater than or equal to 45 degrees, for example of greater than or equal to 60 degrees, and for example extend perpendicularly to one another.

BRIEF DESCRIPTION OF THE DRAWINGS

In the following, the invention will be described in greater detail with reference to the figures of the drawings, in which.

In the drawings, the same reference numerals denote like or functionally like components, unless stated otherwise.

DETAILED DESCRIPTION OF EMBODIMENTS

Figure 1:
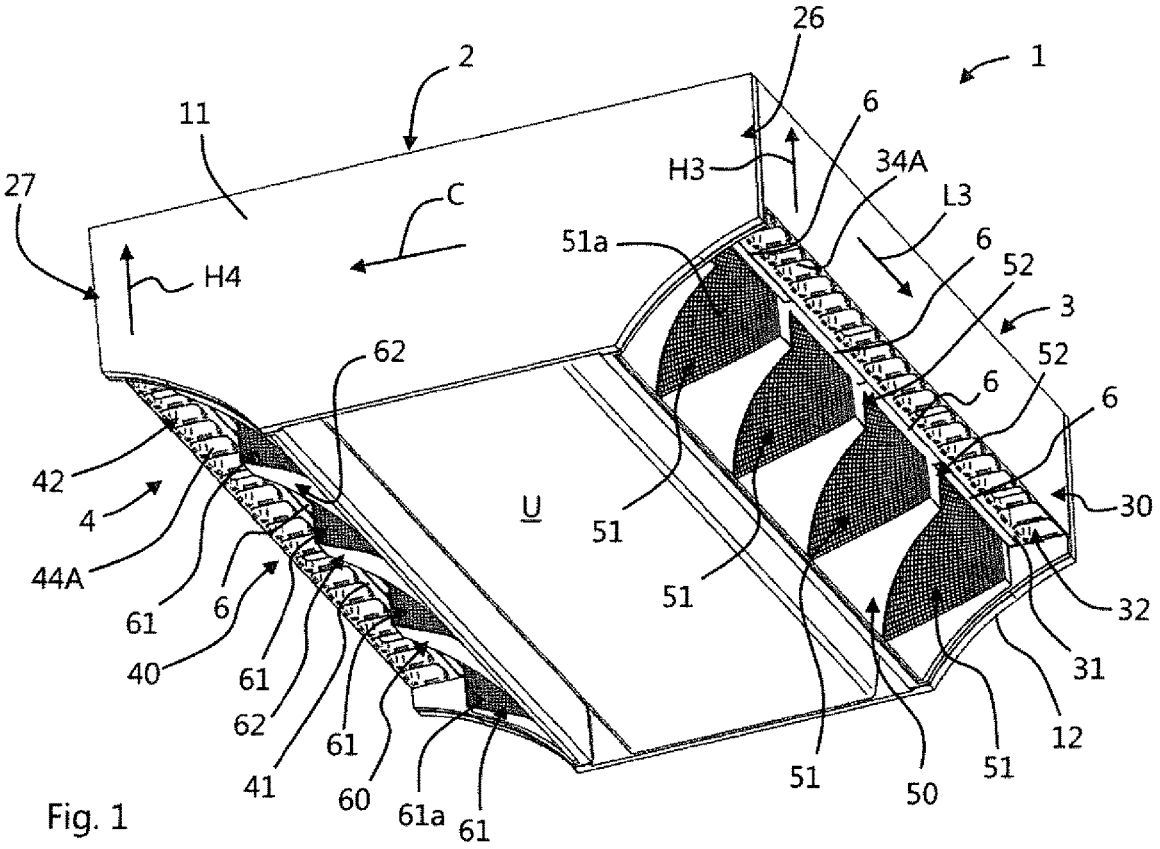
FIG. 1 is a perspective view of a lamp according to one embodiment of the present invention in a viewing direction onto a lower side of the lamp.
Figure 2:
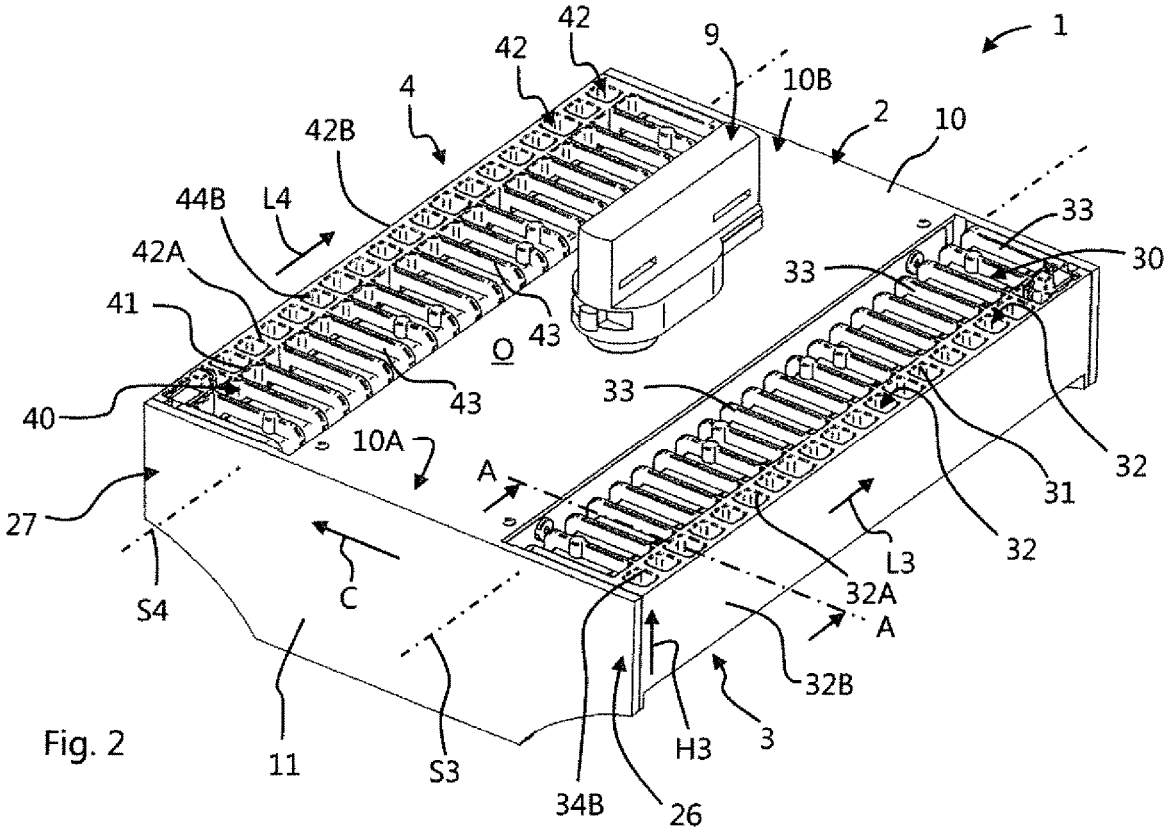
FIG. 2 is a perspective view of the lamp shown in FIG. 1 in a viewing direction onto an upper side of the lamp.
Figure 3:
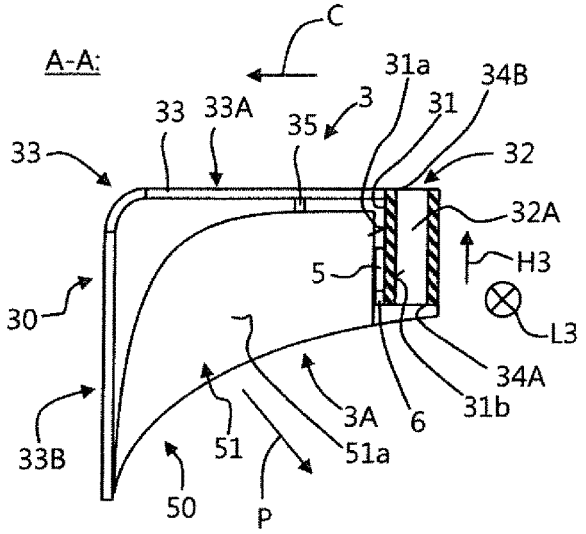
FIG. 3 is a sectional view of a detail of a lighting device of the lamp shown in FIGS. 1 and 2, which view results from a section along the line A-A shown in FIG. 2.
Figure 4:
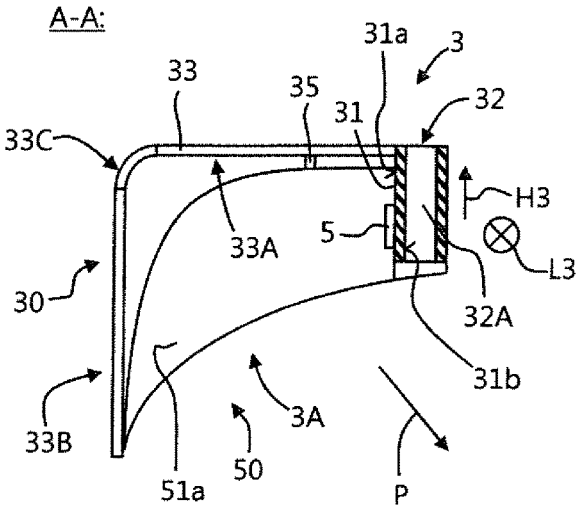
FIG. 4 is a sectional view of a detail of a lighting device from another embodiment of the lamp according to the present invention, which view results from a section along the line A-A shown in FIG. 2.

FIG. 1 is a perspective view of a lamp 1 in a viewing direction onto a lower side U of the lamp 1. FIG. 2 shows the lamp shown in FIG. 1 in a viewing direction onto an upper side O of the lamp 1. FIGS. 3 and 4 each show sectional views which result for different configurations of the lamp 1 from a section along the line A-A shown in FIG. 2.

As shown in FIGS. 1 to 4, the lamp 1 comprises a carrier device 2 and at least one lighting device 3, 4. As can be seen in particular in FIG. 1, the lamp 1 can comprise in particular a first lighting device 3 and a second lighting device 4. The first and the second lighting device 3, 4 can be configured in particular in the same manner. The following information about a lighting device 3, 4 thus applies generally to the first and the second lighting device 3, 4 and to possible additional lighting devices of the lamp 1.

As shown in FIGS. 1 to 4, the lighting device 3, 4 comprises a carrier part 30, 40, a reflector device 50, 60, and a plurality of illuminant devices 5, an illuminant device 5 being shown merely symbolically in FIGS. 3 and 4.

FIGS. 1 and 2 show a lighting device 3, 4 by way of example, said device comprising a carrier part 30, 40 extending in a longitudinal direction L3, L4. The carrier part 30, 40 comprises a lateral wall 31, 41 extending in the longitudinal direction L3, L4. Furthermore, the carrier part 30, 40 comprises a plurality of optional cooling stacks 32, 42 and a plurality of optional ribs 33, 43.

As can be seen in particular in FIGS. 3 and 4, the lighting units 5 are arranged on the lateral wall 31, in particular on a first surface 31*a* of the lateral wall 31. In FIGS. 3 and 4, the lighting units 5 are shown merely symbolically. The lighting units 5 can each be for example in the form of LED lighting units, in particular chip-on-board LED units or chip-scale-packaging LED units.

As can further be seen in particular in FIGS. 1 and 2, the plurality of optional cooling stacks 32, 42 are arranged on the lateral wall 31, 41 of the carrier part 30, 40 and placed one behind the other with respect to the longitudinal direction L3, L4. The cooling stacks 32, 42 each extend in a lighting-device vertical direction H3, H4 extending transversely to the longitudinal direction L3, L4. As shown in particular in FIGS. 3 and 4, the cooling stacks 32, 42 form channels extending in the lighting-device vertical direction H3, the lateral walls of which connect two openings 34A, 34B, 44A, 44B opposite one another in the lighting-device vertical direction H3. As can be seen in particular in FIGS. 1 and 2, the cooling stacks 32, 42 can be formed for example with a rectangular cross section. This can be achieved for example in that, in order to form the cooling stacks 32, 42, webs 32A, 42A are provided on a second surface 31*b* of the lateral wall 31 oriented opposite the first surface 31*a*, which webs protrude from the second surface 31*b* of the lateral wall 31 and extend transversely to the lateral wall 31. Furthermore, an outer plate 32B, 42B extending in the longitudinal direction L3, L4 is provided, which plate connects the webs 32A, 42A. Thus, the lateral wall 31, 41, the webs 32A, 42A and the plate 32B, 42B together define the cross section of the cooling stacks 32, 42.

By means of the extension of the cooling stacks 32, 42 in the lighting-device vertical direction H3, H4, the heat dissipation from the lighting units 5 is improved. As a result, the output of the lighting units 5 can be increased. Consequently, a high luminosity can be produced with only a few, and therefore high-output, lighting units 5. Thus, the space on the lateral wall 31, 41 required for the lighting units 5 is reduced so that the extension of the lateral wall 31, 41 in the longitudinal direction L3, L4 can be reduced.

As further shown in FIGS. 1 to 4, the optional ribs 33, 43 are arranged at a distance from one another with respect to the longitudinal direction L3, L4. The ribs 33, 43 extend from the lateral wall 31, 41 of the carrier part 30, 40. In particular, the ribs 33, 43 protrude from the first surface 31*a* of the lateral wall 31, as shown for example in FIGS. 3 and 4. The ribs 33, 43 can be for example L-shaped or arcuate, as shown by way of example in FIGS. 2 to 4. In this case, the ribs 33 comprise a first portion 33A extending transversely to the lateral wall 31 and a second portion 33B extending transversely to the first portion 33A. The second portion 33B extends in particular in the lighting-device vertical direction H3 or along the lateral wall 31, 41 and is connected to the first portion 33A, for example directly or indirectly by means of a curved third portion 33C, as shown by way of example in FIGS. 3 and 4. Generally, a rib 33, 43 thus extends at least in some portions in a lighting-device vertical direction H3, H4 extending transversely to the longitudinal direction L3, L4.

The reflector device 50, 60 is fastened to the carrier part 30, 40, for example to the optional ribs 33, 43 or to the lateral wall 31, 41. FIGS. 3 and 4 are schematic views of an attachment point 35 moulded onto a rib 33 or onto the reflector device 50, 60. At said attachment point, the reflector device 50, 60 and the rib 33 can be fastened to one another, e.g. by bonding, screwing, latching or in a similar manner. As shown in particular in FIG. 1, the reflector device 50, 60 comprises at least two reflector portions 51, 61 at a distance from one another in the longitudinal direction L3, L4. FIG. 1 shows by way of example a reflector device 51, 61, which comprises four reflector portions 51, 61 in total. Of course, more than four reflector portions 51, 61 can also be provided. The reflector portions 51, 61 are each formed by reflector surfaces 51*a*, 61*a* which are curved concavely in at least two curvature directions. As can be seen in FIG. 1, the reflector surfaces 51*a*, 61*a* forming the reflector portions 51, 61 each define a bowl-shaped or spoon-shaped cavity. In this case, the reflector surfaces 51*a*, 61*a* each extend in a curved manner both with respect to the longitudinal direction L3, L4 and with respect to the lighting-device vertical direction H3, H4. FIG. 1 shows by way of example a course of the reflector surface 51*a*, 61*a* which is mirror-symmetrical with respect to a plane of symmetry extending in the lighting-device vertical direction H3, H4 and being perpendicular to the longitudinal direction L. The sectional line A-A shown in FIG. 1 is located in the plane of symmetry. Optionally, the reflector portions 51, 61 are separated from one another with respect to the longitudinal direction L in each case by intermediate portions 52, 62 extending in the longitudinal direction L. In this case, the intermediate portions 52, 62 follow the course of the edge contour of the respective reflector surfaces 51*a*, 61*a*.

As shown in FIG. 1, in the case where the lamp 1 comprises a first and a second lighting device 3, 4, it can be provided that the at least two reflector portions 51 of the first lighting device 3 and the at least two reflector portions 61 of the second lighting device 4 are oriented in opposite directions. In particular, the reflector surfaces 51*a* of the reflector device 50 of the first lighting device 3, which surfaces form the reflector portions 51, and the reflector surfaces 61*a* of the reflector device 60 of the second lighting device 4, which surfaces form the reflector portions 61, point in different directions with respect to a width direction C extending transversely to the longitudinal direction L.

As shown in FIGS. 1, 3 and 4, the at least two reflector portions 51, 61 of the lateral wall 31, 41 of the carrier part 30, 40 are oriented facing in particular the first surface 31*a* of the lateral wall 31. In particular, in each case one lighting unit 5 is assigned in each case to one of the at least two reflector portions 51, 61. As can be seen in particular in FIGS. 3 and 4, in this way, light can be emitted by the lighting units 5 onto the respective reflector surfaces 51*a*, 61*a* and reflected thereby, as illustrated symbolically by the arrow P in FIGS. 3 and 4.

Figure 10:
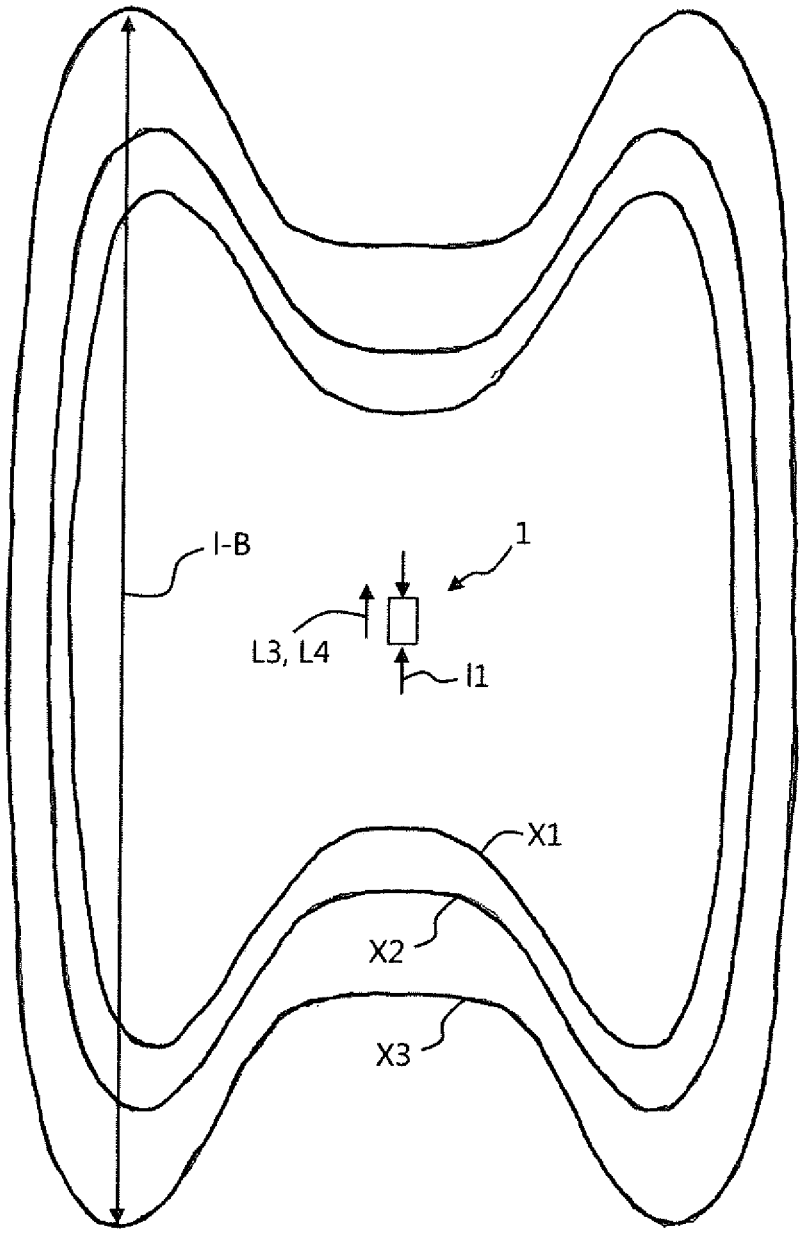
FIG. 10 is a schematic and exemplary illustration of a light distribution which can be achieved by means of the lamp according to the invention.

FIG. 10 is a schematic view of a light distribution which can be achieved by means of the lamp 1, which comprises two lighting devices 3, 4 having reflector devices 50, 60, which lamp, as shown in FIG. 1, is designed with concavely curved reflector portions 51, 61 which are separated from one another. The lines X1, X2 and X3 shown in FIG. 10 each represent lines of the same brightness, the brightness decreasing from the line X1 through the line X2 to the line X3. In the present case, the line X3 defines, by way of example, a lit region B. As can be clearly seen in FIG. 10, the maximum extension I-B of the lit region B is approximately 30 times greater than the length l1 of the lamp 1 with respect to the longitudinal direction L3, L4. By means of the configuration of the reflector device 50, 60, a very compact construction of the lamp L with respect to the lit region B can thus be achieved with a small number of lighting units 5.

As can be seen in particular from FIG. 1, by means of the described configuration of the reflector device 50, 60 with concavely curved reflector portions 51, 61 which are separated from one another, a viewer looking in the longitudinal direction L3, L4 at the lower side U of the lamp 1 is further reliably prevented from being dazzled.

Figure 11:
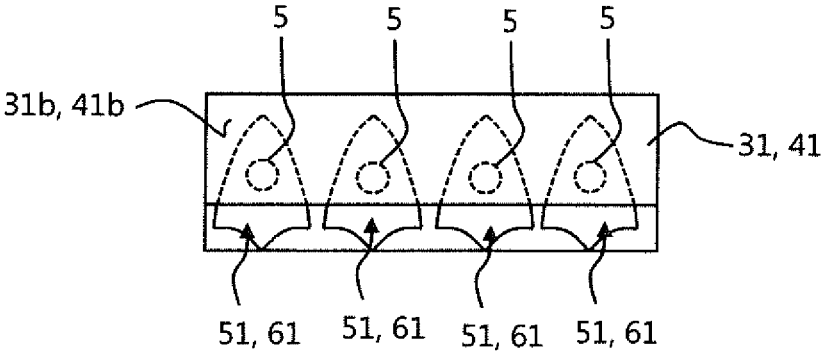
FIG. 11 is a schematic side view of a lamp according to another embodiment of the present invention.

Optionally, the number of lighting units 5 can correspond to the number of reflector portions 51, 61. In this case, in each case one lighting unit 5 is arranged opposite a relevant reflector portion 51, 61 and assigned thereto. This is shown schematically in FIG. 11, FIG. 11 being a plan view of the second surface 31*b*, 41*b* of the lateral wall 31, 41 of the carrier part 30, 40.

As shown by way of example in FIGS. 1 and 3, the at least one lighting device 3, 4 can further comprise a cover strip 6. With respect to the lighting-device vertical direction H3, the cover strip 6 is arranged between a lower end of the lateral wall 31, 41, which is directed towards the lower side U, and the lighting unit 5, and protrudes from the first surface 31*a* of the lateral wall 31, as shown in FIG. 3. As a result, in a viewing direction in the lighting-device vertical direction H3, H4, the lighting units 5 are covered by the cover strip 6, and thus a viewer looking at the lower side U of the lamp is more reliably prevented from being dazzled. In this case, the reflector surface 51*a*, 61*a* forming the relevant reflector portion 51, 61 and the cover strip 6 together define a relevant light outlet opening 3A in the lamp 1 in each case, as shown schematically in FIG. 3.

As shown in particular in FIG. 1, the cover strip 6 extends in the longitudinal direction L3, L4. It can also be seen in FIG. 1 that a plurality of cover strips 6 can be provided one behind the other with respect to the longitudinal direction L3, L4, for example one cover strip 6 per reflector portion 51, 61.

FIG. 4 shows by way of example that the reflector surface 51*a* forming a relevant reflector portion 51, 61 and the first surface 31*a* of the lateral wall 31 of the carrier part 30 together define a relevant light outlet opening 3A in the lamp 1 in each case. As shown in FIG. 4, in this case the reflector surface 51*a* extends as far as the first surface 31*a* of the lateral wall 31. The intermediate portion 52, which cannot be seen in FIG. 4, since said portion is placed behind the reflector surface 51*a* with respect to the longitudinal direction L3, in this case is located in particular on the surface 31*a* of the lateral wall 31. Thus, in a viewing direction in the longitudinal direction L3, the lighting unit 5 which follows with respect to the longitudinal direction L3 is covered by the reflector surface 51*a*. This further improves the dazzle protection for a viewer looking at the lower side U of the lamp 1 in the longitudinal direction L3, L4.

In FIGS. 1 and 2, the carrier device 2 comprises, by way of example, a longitudinal carrier 10 and a first transverse carrier 11 and a second transverse carrier 12. The longitudinal carrier 10 extends in the longitudinal direction L3, L4. The first and the second transverse carrier 11, 12 each extend transversely to the longitudinal carrier 11, 12, in particular in the width direction C. The first transverse carrier 11 is arranged on a first end portion 10A of the longitudinal carrier 10. The second transverse carrier 12 is on a second end portion 10B of the longitudinal carrier 10, which is placed opposite the first end portion 10B with respect to the longitudinal direction L3, L4. As shown by way of example in FIGS. 1 and 2, the transverse carriers 11, 12 can each be designed as plates. The lighting device 3, 4 in this case can be in particular mounted on the transverse carriers 11, 12 or coupled thereto. As shown in FIG. 2, an adapter 9 can be arranged on the longitudinal carrier 10. Said adapter is provided for the electrical and, for example, also mechanical connection of the spotlight to a holder, such as a bus bar (not shown) which can be arranged on a ceiling.

Figure 5:
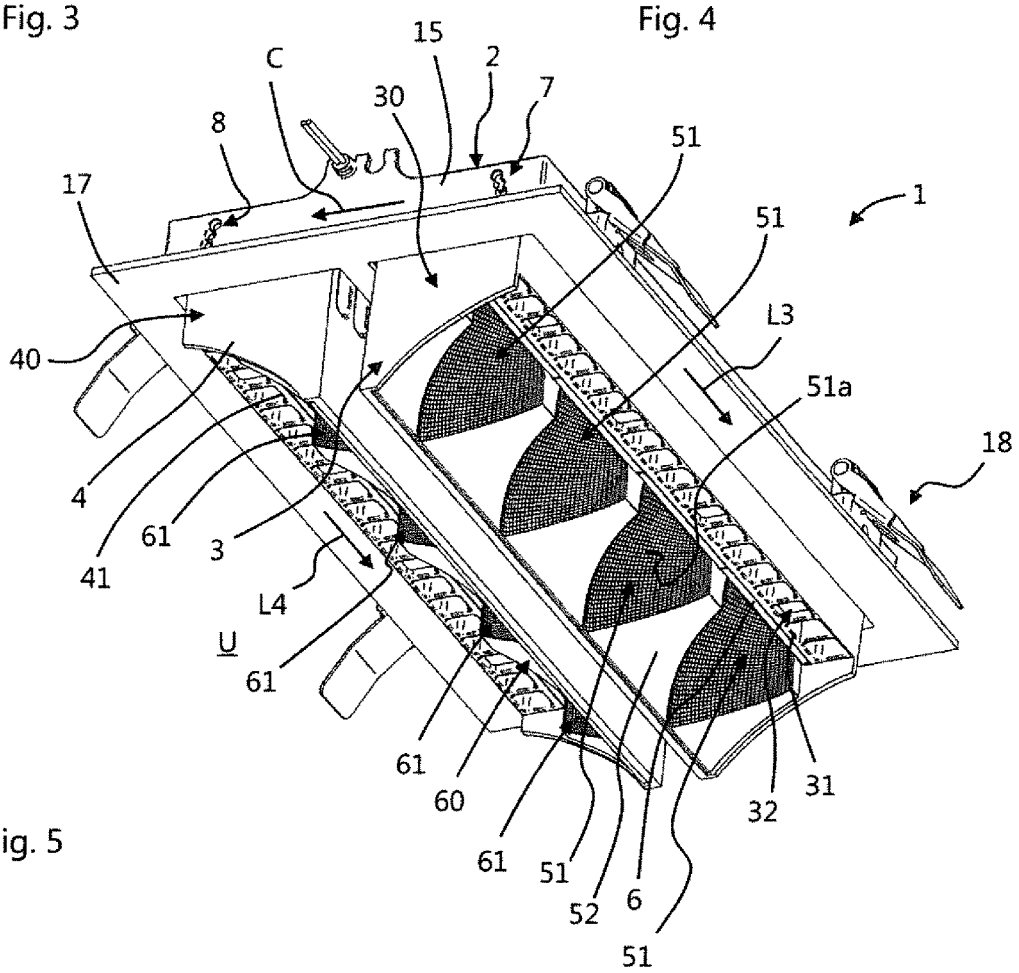
FIG. 5 is a perspective view of a lamp according to another embodiment of the present invention in a viewing direction onto a lower side of the lamp.
Figure 6:
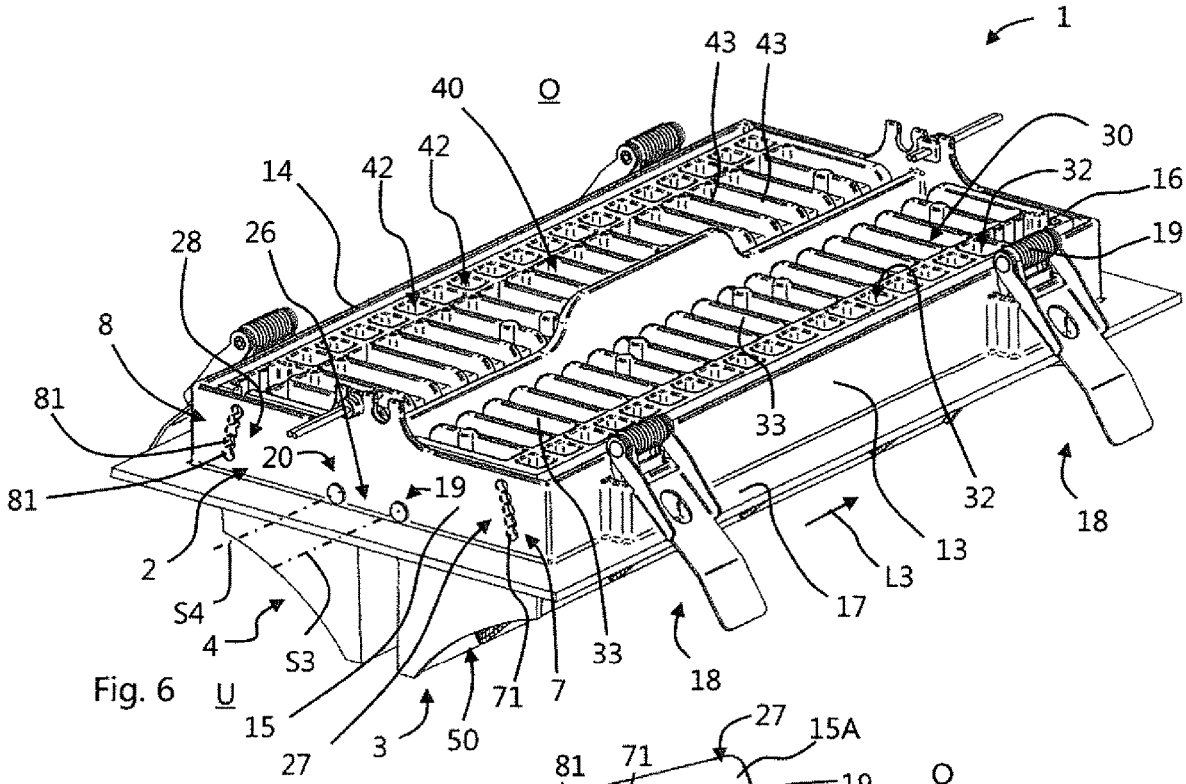
FIG. 6 is a perspective view of the lamp shown in FIG. 5 in a viewing direction onto an upper side of the lamp.

The lamp 1 shown in FIGS. 5 and 6 differs from the lamp 1 described above with reference to FIGS. 1 to 4 merely in terms of the design of the carrier device 2. Otherwise, the lamp 1 shown in FIGS. 5 and 6 and the lamp shown in FIGS. 1 and 2 have the same construction. As shown in FIGS. 5 and 6, in this case it can also be provided that the reflector surfaces 51*a* of the reflector device 50 of the first lighting device 3, which surfaces form the reflector portions 51, and the reflector surfaces 61*a* of the reflector device 60 of the second lighting device 4, which surfaces form the reflector portions 61, point in different directions with respect to the width direction C.

As shown in FIGS. 5 and 6, the carrier device 2 of the lamp 1 can be in the form of a peripheral, rectangular frame. To form a peripheral, in particular closed frame, the carrier device 2 thus comprises two longitudinal struts 13, 14 extending in the longitudinal direction L3, L4 and two transverse struts 15, 16 extending transversely to and interconnecting said longitudinal struts. Optionally, a peripheral strip 17 protruding outwards from the struts 13, 14, 15, 16 can further be provided on the carrier device. The peripheral frame can advantageously be inserted into a mounting recess, which is provided for example in a ceiling of a room of a building. In this case, the optional strip is used for attachment to the ceiling.

As shown in FIGS. 5 and 6, a fastening device 18 for fastening the frame to a ceiling can further be provided on the carrier device 2, which fastening device is designed as a bracket by way of example in FIGS. 5 and 6. Said bracket is rotatably mounted on the carrier device 2, in particular on the longitudinal strut 13, and biased in the direction of the strip 17 by means of a spring 19.

Figure 7:
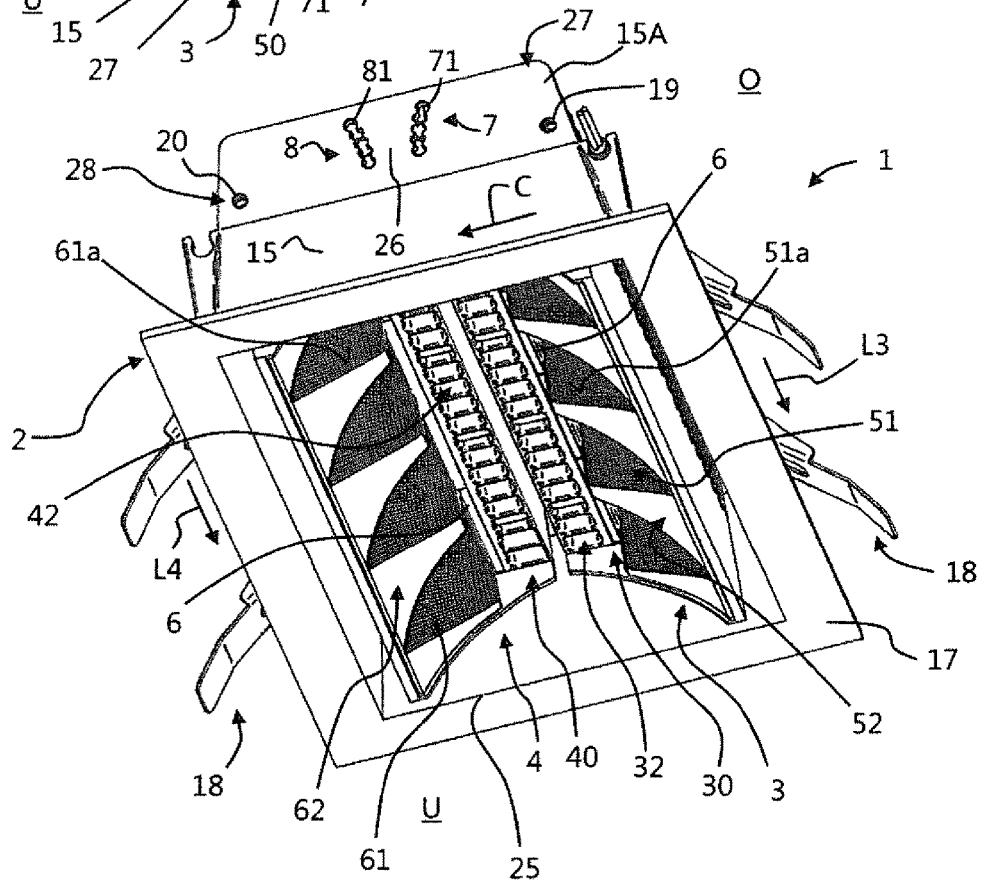
FIG. 7 is a perspective view of a lamp according to another embodiment of the present invention in a viewing direction onto a lower side of the lamp.
Figure 8:
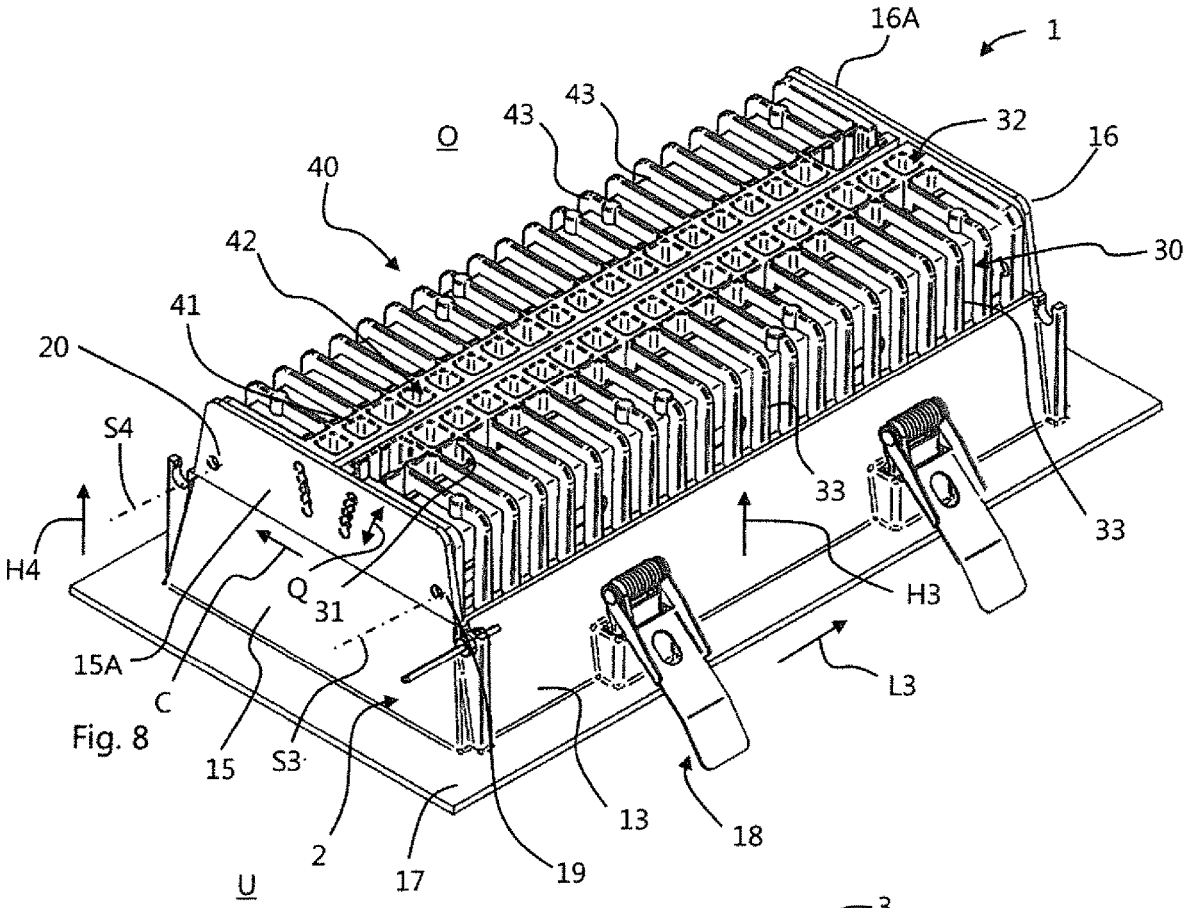
FIG. 8 is a perspective view of the lamp shown in FIG. 7 in a viewing direction onto an upper side of the lamp.

The lamp 1 shown by way of example in FIGS. 7 and 8 differs from the lamps 1 shown in FIGS. 1 and 2 and in FIGS. 5 and 6 in particular in terms of the arrangement of the first and second lighting devices 3, 4 relative to one another and in part in terms of the design of the carrier device 2. However, the first and second lighting devices 3, 4 have the same construction, as has been described with reference to FIGS. 1 to 6.

As shown in FIGS. 7 and 8, the first and the second lighting device 3, 4 can be arranged relative to one another in such a way that the reflector surfaces 51*a*, which form the reflector portions 51 of the reflector device 50 of the first lighting device 3, and the reflector surfaces 61*a*, which form the reflector portions 61 of the reflector device 60 of the second lighting device 4, are oriented so as to be mutually facing. As shown in FIGS. 7 and 8, the lateral wall 31 of the carrier part 30 of the first lighting device 3 in this case is placed facing the lateral wall 41 of the carrier part 40 of the second lighting device 4. The optional stacks 42, 32 in this case are placed between the lateral walls 31 and 41, as shown by way of example in FIG. 8.

As shown in particular in FIG. 8, the carrier device 2 can also comprise longitudinal struts 13, 14 and transverse struts 15, 16, which form a closed frame, as well as the optional strip 17 and the optional fastening device 18, as has been explained with reference to FIGS. 5 and 6. In contrast with the carrier device 2 of the lamp 1 shown in FIGS. 5 and 6, the carrier device of the lamp 1 shown in FIGS. 7 and 8 comprises an optional extension plate 15A, 16A on each of the transverse struts 15, 16, which plate extends from the respective transverse struts 15, 16 in the vertical direction H3, H4 or protrudes from the respective transverse struts 15, 16 with respect to the vertical direction H3, H4 and thereby extends said struts in the vertical direction H3, H4. In particular, the at least one lighting device 3, 4 can be mounted on the extension plates 15A, 16. This offers the advantage that the at least one lighting device 3, 4 is placed inside the frame with respect to the vertical direction, as shown by way of example in FIG. 7, or ends flush with the lower edge 25 of the frame which is defined by the transverse struts 15, 16 and the longitudinal struts 13, 15 or optionally by the strip 17. In this way, the lamp 1 can advantageously be integrated in a ceiling of a room in such a way that the lamp 1 does not protrude, or protrudes to only a minimal extent, into the room. As a result, the aesthetic appearance of the lamp 1 when mounted is improved.

Figure 9:
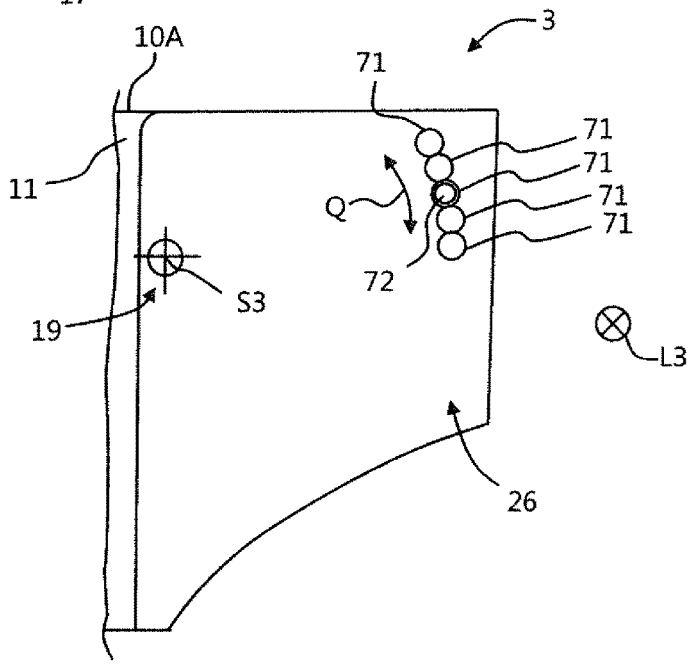
FIG. 9 is a view of a detail of the lamp according to another embodiment of the present invention, which view results from a viewing direction in a longitudinal direction.

FIG. 9 shows by way of example a detail of the lamp 1 shown in FIG. 1 in a plan view of the first transverse carrier 11 in a viewing direction in the longitudinal direction L3, L4, the transverse carrier 11 being shown transparently. As shown by way of example in FIG. 9, the at least one lighting device 3, 4 can be mounted on the carrier device 2 so as to be able to rotate about a pivot axis S3, S4 extending in the longitudinal direction L3, L4. In FIGS. 2, 6 and 8, the pivot axes S3 and S4 are each drawn in as dotted lines. In the case of the lamp 1 shown in FIGS. 1 and 2, the lighting devices 3, 4 can each be rotatably mounted for example on the transverse carriers 11, 12. In the case of the lamp 1 shown in FIGS. 5 and 6, the lighting devices 3, 4 can each be rotatably mounted for example on the transverse struts 15, 16. In the case of the lamp 1 shown in FIGS. 7 and 8, the lighting devices 3, 4 can each be rotatably mounted for example on the extension plates 15A, 16A. The pivotal mounting can be produced in particular by articulation means 19, 20. The articulation means 19, 20 can for example each comprise a bush (not shown) and a pin (not shown) which is rotatably mounted therein, the pin being provided on the relevant transverse carrier 11, 12 or on the relevant transverse strut 15, 16 or on the relevant extension plate 15A, 16A, and the bush being provided at the end of the lighting device 3, 4 or vice versa. This configuration makes it possible to pivot the lighting device 3, 4 about the pivot axis S3, S4, as indicated symbolically by the arrow Q in FIG. 9. This offers the advantage in particular that the radiation direction of the light can be adapted in a simple and flexible manner.

FIG. 9 further shows a possible design of an optional fixing device 7, 8 for fixing the at least one lighting device 3, 4 in a pivot position. As can be seen in FIG. 9 for the lamp 1 shown in FIGS. 1 and 2, and in FIGS. 5 and 6, and 7 and 8 for the lamp 1 shown therein in each case, the fixing device 7, 8 assigned to the relevant lighting device 3, 4 can be in the form of a latching mechanism. As shown in particular in FIGS. 6 to 9, the latching mechanism comprises a plurality of recesses 71, 81, which are arranged on a circular path, the centre of which coincides with the pivot axis S3, S4, and which recesses can be formed in at least one of the transverse struts 15, 16 or in at least one of the transverse carriers 11, 12. Furthermore, the latching mechanism comprises a ball 72 which is coupled to the lighting device 3, 4, which is biased in the longitudinal direction L3, L4 by means of a spring (not shown) and which can be engaged in an interlocking manner in the recesses 71, 81. When pivoting the lighting device 3, 4 as indicated by the arrow Q in FIG. 9, the ball 72 is pushed out of a recess 71, 81 and engages again in the recess 71, 81, the seat of which corresponds to the desired pivot position of the lighting device 3, 4. As a result, the fixing device 7, 8 fixes the lighting device 3, 4 in the desired pivot position.

In the case of the lamp 1 shown in FIGS. 5 and 6, the pivot axis S3, S4 or the articulation means 19, 20 forming said pivot axis is arranged in a region 26 of the carrier device 2 or of the transverse struts 15, 16 which is central with respect to the transverse direction C, and the optional fixing device 7, 8 is arranged in a region 27, 28 of the carrier device 2 or of the transverse struts 15, 16 which is outer with respect to the transverse direction C. In the case of the lamp 1 shown in FIGS. 7 and 8, the pivot axis S3, S4 or the articulation means 19, 20 forming said pivot axis is arranged in a region 27, 28 of the carrier device 2 or of the transverse struts 15, 16 which is outer with respect to the transverse direction C, and the optional fixing device 7, 8 is arranged in a region 26 of the carrier device 2 or of the transverse struts 15, 16 which is central with respect to the transverse direction C. In the case of the lamp 1 shown in FIGS. 1 and 2, the pivot axis S3, S4 or the articulation means 19, 20 forming said pivot axis is arranged between the longitudinal carrier 10 and the outer region 26, 27 with respect to the transverse direction C, and the optional fixing device is arranged in the outer region 26, 27. On the lighting device 3, 4, the corresponding part of the articulation means 19, 20, that is to say the pin or bush (in each case not shown), is arranged at a distance from the lateral wall 31, 41 in the direction of the reflector portions 51, 61, as indicated symbolically in particular by the pivot axis S3, S4 in FIGS. 2, 6 and 8.

Although the present invention has been explained above by way of example with reference to embodiments, it is not restricted to said embodiments, but rather can be modified in various ways. In particular, combinations of the above embodiments are also conceivable.

The invention claimed is:

1. A lamp, comprising:

a carrier device; and at least one lighting device extending in a longitudinal direction and mounted on the carrier device, the lighting device comprising:

a carrier part that includes a lateral wall extending in the longitudinal direction and having a first surface and a second surface oriented opposite to the first surface, a first end wall extending transverse from a first end of the lateral wall in a transverse direction, and a second end wall extending transverse from a second end of the lateral wall parallel to the first end wall, a plurality of lighting units which are arranged on the first surface of the lateral wall of the carrier part, and a reflector device fastened to the carrier part and extending between the first and second end walls;

wherein the reflector device includes at least two reflectors formed by reflector surfaces which are concavely curved at least with respect to the longitudinal direction and with respect to a vertical direction so as to form a bowl-shaped or spoon-shaped cavity, wherein the vertical direction extends transverse to the longitudinal direction and to the transverse direction;

wherein the at least two reflectors are separated from each other in the longitudinal direction by a planar intermediate segment extending in the longitudinal direction parallel to the first surface of the lateral wall of the carrier part;

wherein the at least two reflectors are oriented facing the first surface of the lateral wall of the carrier part; and wherein a lighting unit is assigned in each case to one of the at least two reflectors.

2. The lamp of claim 1, wherein the number of lighting units corresponds to the number of reflectors, and in each case one lighting unit is arranged opposite a relevant reflector and is assigned thereto.

3. The lamp of claim 1, wherein the carrier part of the lighting device comprises a plurality of ribs which extend from the lateral wall of the carrier part at least in portions in a lighting-device vertical direction extending transversely to the longitudinal direction.

4. The lamp of claim 1, wherein the reflector surfaces forming the at least two reflectors reaches as far as the first surface of the lateral wall of the carrier part, on which the lighting units are arranged, and wherein the planar intermediate segment of the reflector device that separates the reflectors from one another with respect to the longitudinal direction is located in contact with the first surface of the lateral wall of the carrier part, so that a light outlet opening of the lamp, in each case, is limited by the respective reflector surface and the first surface of the lateral wall.

5. The lamp of claim 1, wherein the at least one lighting device further comprises a cover strip arranged on the first surface of the lateral wall of the carrier part between the lighting units and a lower end of the lateral wall with respect to the transverse direction.

6. The lamp of claim 5, wherein the reflector surfaces forming the at least two reflectors reach as far as the cover strip, wherein the planar intermediate segment of the reflector device, which separates the reflectors from one another with respect to the longitudinal direction, is located in contact with the strip, so that a light outlet opening of the lamp is limited, in each case, by the respective reflector surface and the cover strip.

7. The lamp of claim 1, wherein the lighting units are each in the form of LED lighting units.

8. The lamp of claim 7, wherein the lighting units are in the form of chip-on-board LED units.

9. The lamp of claim 7, wherein the lighting units are in the form of chip-scale-packaging LED units.

10. The lamp of claim 1, wherein the lighting units are each configured for an electric power supply with an operating current of between 300 mA and 1050 mA.

11. The lamp of claim 1, wherein the at least one lighting device is mounted on the carrier device so as to be able to rotate about a pivot axis extending in the longitudinal direction.

12. The lamp of claim 11, wherein the lamp comprises a fixing device for fixing the at least one lighting device in a pivot position.

13. The lamp of claim 1, wherein the carrier device comprises a longitudinal carrier extending in the longitudinal direction, a first transverse carrier arranged on a first end portion of the longitudinal carrier and extending transversely thereto, and a second transverse carrier which is arranged on a second end portion of the longitudinal carrier and extends transversely to the longitudinal carrier.

14. The lamp of claim 1, wherein the carrier device is in the form of a peripheral rectangular frame.

15. The lamp of claim 1, wherein the lamp comprises a first lighting device and a second lighting device.

16. The lamp of claim 15, wherein the at least two reflectors portions of the first lighting device and the at least two reflectors of the second lighting device are oriented in opposite directions.

17. The lamp of claim 15, wherein the at least two reflector portions of the first lighting device and the at least two reflector portions of the second lighting device are oriented so as to be mutually facing.

18. The lamp of claim 1, wherein the lighting device further comprises a plurality of cooling stacks placed one behind the other with respect to the longitudinal direction, wherein the cooling stacks are formed on the second surface of the lateral wall of the carrier part by peripheral walls extending in the vertical direction and forming channels having a completely closed cross section, and wherein the peripheral walls connect two openings of the channel that are arranged opposite one another in the vertical direction.

19. A lamp comprising:

a carrier device; and at least one lighting device mounted on the carrier device, the lighting device comprising:

a carrier part which includes a lateral wall extending in a longitudinal direction and having a first surface and a second surface oriented opposed to the first surface, a first end wall extending transverse from a first end of the lateral wall in a transverse direction, and a second end wall extending transverse from a second end of the lateral wall parallel to the first end wall, a plurality of lighting units which are arranged on the first surface of the lateral wall of the carrier part, a plurality of cooling stacks placed one behind the other with respect to the longitudinal direction, wherein the cooling stacks are formed on the second surface of the lateral wall of the carrier part by peripheral walls extending in a vertical direction and forming channels having a completely closed cross section, the vertical direction extending transverse to the longitudinal direction and to the transverse direction, wherein the peripheral walls connect two openings of the channel that are arranged opposite one another in the vertical direction, and a reflector device fastened to the carrier part and extending between the first and second end walls, wherein the reflector device includes at least two reflectors that are positioned distanced from one another in the longitudinal direction, each of the at least two reflectors being formed by reflector surfaces which are concavely curved at least with respect to the longitudinal direction and with respect to the vertical direction so as to form a bowl-shaped or spoon-shaped cavity, wherein the at least two reflectors are oriented facing the inner surface of the lateral wall of the carrier part, and wherein a lighting unit is assigned in each case to one of the at least two reflectors.

* * * * *